United States Patent [19]

Dragone et al.

[11] Patent Number: 4,482,897

[45] Date of Patent: Nov. 13, 1984

[54] MULTIBEAM SEGMENTED REFLECTOR ANTENNAS

[75] Inventors: Corrado Dragone, Little Silver; Michael J. Gans, Monmouth Beach, both of N.J.

[73] Assignee: AT&T Bell Laboratories, Murray Hill, N.J.

[21] Appl. No.: 392,607

[22] Filed: Jun. 28, 1982

[51] Int. Cl.[3] ..... H01Q 19/19

[52] U.S. Cl. ..... 343/779; 343/781 P

[58] Field of Search ..... 343/781 R, 781 P, 781 CA, 343/DIG. 2, 772, 777, 778, 779, 834, 836, 837, 893, 912, 914, 352, 354, 368, 371, 775, 776

[56] References Cited

U.S. PATENT DOCUMENTS

| | | | |
|---|---|---|---|
| 2,598,475 | 5/1952 | White, Jr. | 343/914 |
| 2,702,859 | 2/1955 | Robinson | 343/781 R |
| 3,108,279 | 10/1963 | Eisentraut | 343/775 |
| 3,370,295 | 2/1968 | Kelsey | 343/781 R |
| 3,881,178 | 4/1975 | Hannan | 343/779 |
| 3,914,768 | 10/1975 | Ohm | 343/779 |
| 4,149,227 | 4/1979 | Dorman | 362/297 |
| 4,190,355 | 2/1980 | Avery et al. | 355/71 |
| 4,236,161 | 11/1980 | Ohm | 343/781 CA |
| 4,259,674 | 3/1982 | Dragone et al. | 343/909 |
| 4,315,262 | 2/1982 | Acampora et al. | 343/100 ST |

FOREIGN PATENT DOCUMENTS

| | | | |
|---|---|---|---|
| 77159 | 7/1978 | Japan | 343/779 |

OTHER PUBLICATIONS

R. C. Hansen, "Microwave Scanning Antennas," Academic Press, 1964, pp. 129–132.

*Primary Examiner*—Eli Lieberman
*Assistant Examiner*—Michael C. Wimer
*Attorney, Agent, or Firm*—Erwin W. Pfeifle

[57] ABSTRACT

The present invention relates to antennas with a segmented reflecting surface for providing fully or partially overlapping beams from separate feeds associated with each segment without incurring cross-coupling between feeds and power loss. More particularly, a main reflector or a subreflector reflecting surface is segmented to provide separate images of the far field area of the antenna on separate focal surfaces in the vicinity of an original focal surface of a corresponding non-segmented antenna. Feeds disposed at essentially corresponding locations on each of the far field area images produced by each of the segments provide separate beam footprints which overlap each other in the far field area by a predetermined amount.

8 Claims, 7 Drawing Figures

MULTIBEAM SEGMENTED REFLECTOR ANTENNAS

BACKGROUND OF THE INVENTION

1. Field of the Invention

The present invention relates to segmented reflector antennas for producing overlapping antenna beams from separate feeds without incurring cross-coupling between feeds and power loss. More particularly, the reflecting surface is segmented to provide separate images of the far field in the vicinity of the original focal surface of the antenna. Feeds disposed at corresponding locations on each of the far field images produced by each of the segments provide separate beam footprints which overlap each other by predetermined amounts.

2. Description of the Prior Art

Reflector antennas can produce a multiplicity of beams in different directions by feeding the reflectors with different horns placed at different locations. However, the resultant beams do not, in general, overlap to provide approximately uniform coverage over the field of view of the antenna. Conventional methods, employed to make the coverage more uniform, involve making the feed horns very small in order to pack them closer together resulting in a power loss due to reflector spillover and mutual coupling between feeds. By sharing feed horns between two or more beams the spillover can be reduced, but the mutual coupling remains while waveguide feed networks are made more complicated.

A typical prior art multiple bean antenna is disclosed in U.S. Pat. No. 3,914,768 issued to E. A. Ohm on Oct. 21, 1975. There, a multiple beam antenna configuration is disclosed which supports a plurality of angularly displaced but well-isolated beams and exhibits essentially zero aperture blockage. A plurality of feed horns are clustered around the on-axis focal point of an offset Cassegrainian antenna in which the subreflector is displaced from the aperture to avoid blockage. This hyperbolic subreflector is sized and shaped to accommodate the plurality of beams and the feeds are individually aimed toward the subreflector so that all of the beam centers impinge upon the common effective center of the main parabolic reflector.

Another prior art multiple beam antenna is disclosed in U.S. Pat. No. 4,236,161 issued to E. A. Ohm on Nov. 25, 1980. There a multiple beam antenna arrangement is disclosed which provides a plurality of communication beams for illuminating a predetermined zone. Plural feed horns are disposed on the focal surface of an offset antenna, which horns are energized in cluster groups which produce contiguous beams of predetermined frequencies and polarizations. Adjacent cluster groups operate at diverse frequencies and share at least one feed horn to provide area coverage of the zone. Orthogonally polarized spot beams cover high traffic areas such as cities.

Another prior art multiple beam scanning antenna is disclosed in U.S. Pat. No. 4,315,262 issued to A. Acampora et al on Feb. 9, 1982. There in FIGS. 6–9 an array antenna is shown for limited scanning over multiple independent linear strip subdivisions of a total service area. More particularly, each row of feed elements of the feed array acts essentially as a line source which radiates a wavefront that is transformed by a reflector into a spot beam in the far field. This spot beam can then be scanned over a linear portion of the far field.

The problem remaining in the prior art is to provide a multibeam antenna arrangement wherein beams can be made to overlap each other to provide approximately uniform coverage of the field of view of the antenna while avoiding mutual coupling between feeds.

SUMMARY OF THE INVENTION

The foregoing problem has been solved in accordance with the present invention which relates to segmented reflector antennas for producing overlapping antenna beams from separate feeds without incurring cross-coupling between feeds and power loss. More particularly, the reflecting surface is segmented to provide separate images of the far field in the vicinity of the original focal surface of the antenna. Feeds disposed at corresponding locations on each of the far field images produced by each of the segments provide separate beam footprints which overlap each other by predetermined amounts.

It is an aspect of the present invention to provide a segmented multibeam antenna arrangement which provides overlapping beam footprints and eliminates coupling between feeds. More particularly, by segmenting the main reflector or subreflector of an antenna, multiple sets of beams can be generated using separate feed locations. Although the beams may overlap in the far field, the separate feeds do not couple and the feeds are sufficiently separated so that they may be sized to minimize spillover. The overlapping of the beams is made adjustable to permit the coverage to be more uniform. Additionally, corresponding feeds at the separate locations can be connected with phase shifters to form a series of linearly scanned phased array beams.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Satellite antennas have generally been designed to provide wide area far field coverage using either a single wide area beam, multiple spot beams, a single or multiple scanning spot beam or a combination of such beams. The difficulty in using multiple spot beams to accomplish wide area coverage, such as Contiguous United States (CONUS) coverage, is that beams must overlap so that at the point where the beams meet or crossover, their directivity or gain must not be significantly lower than their maximum directivity or gain at beam center. However, the physical size of feedhorns separate the beams by too large an angle to get the beams to properly overlap and in turn the gain is down by a significant amount where beams meet when using multiple feedhorns in a typical single main reflector antenna arrangement.

The present invention relates to a multibeam antenna arrangement which provides wide area coverage with separate multiple waveguide ports. Such arrangement is hereinafter described primarily in use as a satellite antenna arrangement. It should be understood that such use, although preferred, is for exemplary purposes only and is not for purposes of limitation since the present invention culd have use in terrestrial or satellite microwave radio systems.

Figure 1:
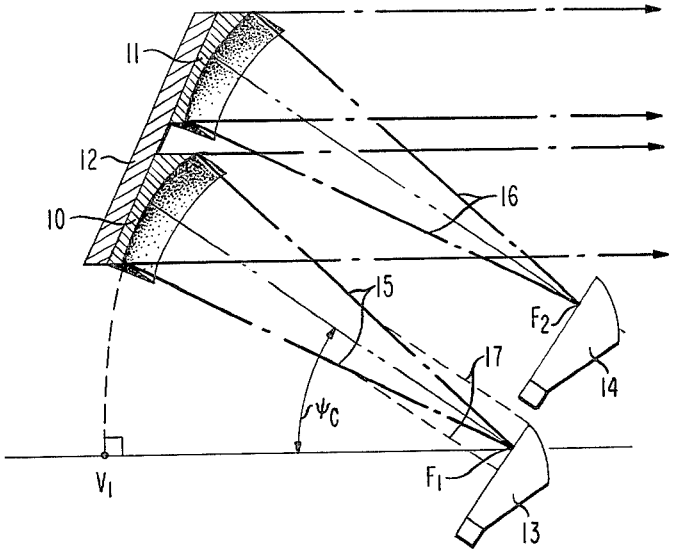
FIG. 1 is an antenna arrangement in accordance with the present invention comprising a segmented main reflector for launching separate partially or fully overlapping beams.
Figure 2:
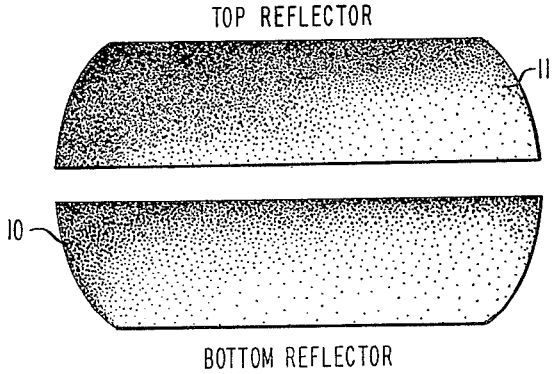
FIG. 2 is a front view of an exemplary configuration of the main reflector segments in the antenna arrangement of FIG. 1.

FIG. 1 illustrates an exemplary short-focal-length antenna arrangement in accordance with the present invention comprising a segmented main reflector which permits beams to be fully or partially superimposed on other beams without coupling losses. More particularly, in FIG. 1 the main reflector is shown as comprising a first and a second curved focusing reflector segment 10 and 11 mounted on a mounting member 12. Each of the first and second reflector segments 10 and 11 are further shown in an offset configuration by an angle $\Psi_c$, and with the respective curved focusing reflecting segments 10 and 11 being focused to separate focal points $F_1$ and $F_2$, respectively. Point $V_1$ is the imaginary intersection point of the extended reflecting surface of reflector segment 10 on the associated axis $F_1V_1$ of the reflecting surface. A similar intersection point could be constructed for the curved reflecting surface of reflector segment 11 on its axis. A front view of an exemplary arrangement of first and second reflector segments 10 and 11 is shown in FIG. 2.

A first and a second feed 13 and 14 are shown disposed at focal points $F_1$ and $F_2$, respectively, which are corresponding image points of the far field on respective first and second focal surfaces for launching respective first and second beams 15 and 16 of electromagnetic energy which are then reflected by first and second reflector segments 10 and 11. Feeds 13 and 14 are illustrated as horns but it is to be understood that any other form of feed arrangement may be used which does not provide a scanning beam. The dashed lines 17 merely indicate an extension of the aperture of horn 13. The first and second focal surfaces are formed in the vicinity of an original focal surface (not shown) which would be formed by a single main reflector having the same curvature as the first and second segments 10 and 11 and disposed at the two segments.

In the transmitting mode, feeds 13 and 14 can selectively or concurrently launch the associated first and second beams 15 and 16 towards the respective reflector segments 10 and 11. The reflector segments 10 and 11, in turn, transform the spherical wavefronts from feeds 13 and 14 into planar wavefronts at the aperture of the antenna arrangement. By proper orientation of feeds 13 and 14 on the far field images produced by the reflector segments 10 and 11, the two beams 15 and 16 can be made to be either fully or partially superimposed upon one another in the far field.

Figure 3:
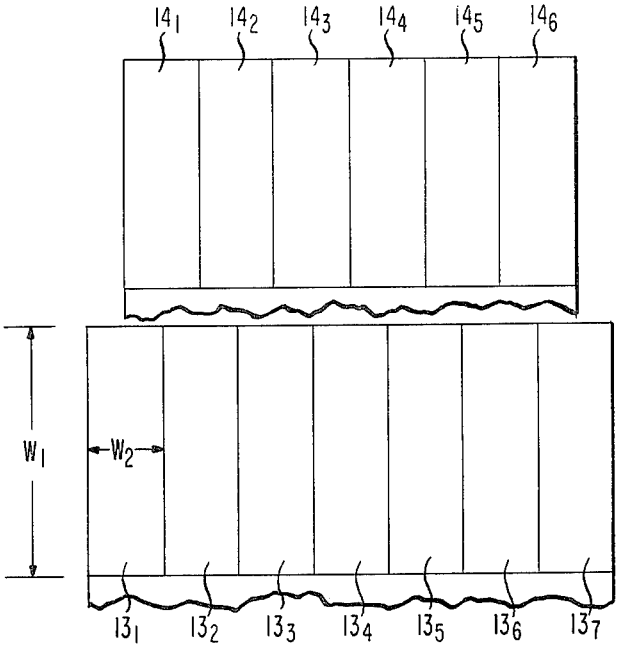
FIG. 3 is a front view of two exemplary linear arrays that can be disposed in the area of the feeds in the antenna arrangement of FIG. 1.
Figure 4:
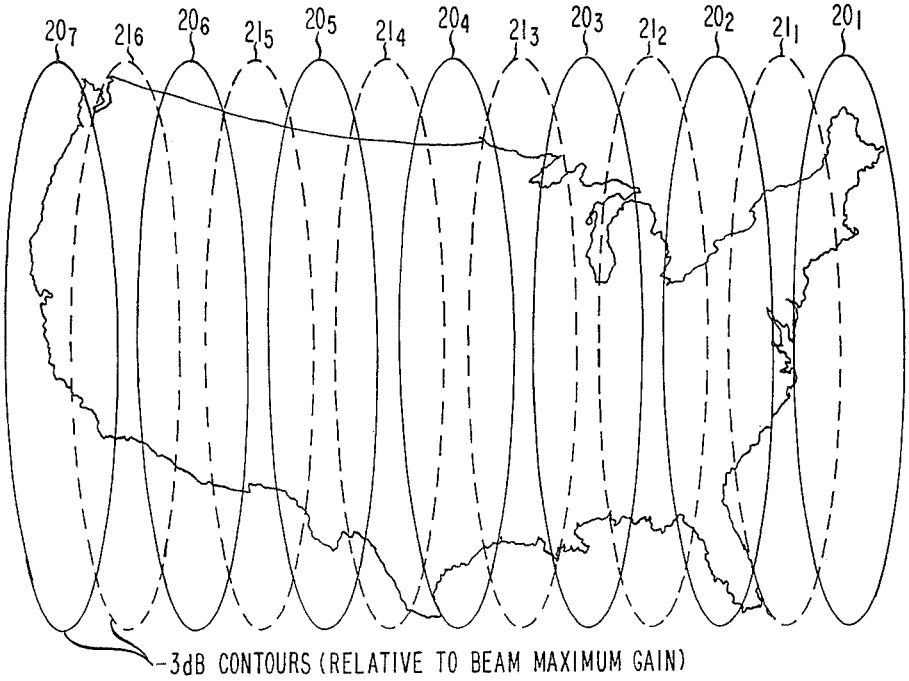
FIG. 4 is a view of the Continental United States with beam footprints superimposed thereon as might be generated with the antenna arrangement of FIGS. 1 and 3.

In a preferred embodiment, additional feeds would be disposed on either side of feeds 13 and 14 shown in FIG. 1 and parallel to the major axis of each of the associated reflector segments 10 and 11. A front view of an exemplary arrangement including seven feeds $13_1$–$13_7$ and six feeds $14_1$–$14_6$ is shown in FIG. 3. There, feeds 13 and 14 each have an aperture with a major axis dimension $W_1$ and a minor axis dimension $W_2$ and are offset from the corresponding feed in the other group by a dimension $W_2/2$. By themselves, feeds $13_1$–$13_7$ launch beams $15_1$–$15_7$, respectively, which are reflected by reflector segment 10. If the antenna arrangement of FIGS. 1 and 3 were used, for example, as a satellite antenna for CONUS coverage, then beams $15_1$–$15_7$ might provide the exemplary footprints $20_1$–$20_7$, respectively, in the far field as shown in FIG. 4. From FIG. 4 it can clearly be seen that adjacent feeds that abut each other do not provide −3 dB contours which abut or overlap each other to provide full CONUS coverage.

Feeds $14_1$–$14_6$ and reflector segment 11, however, can be oriented with respect to feeds $13_1$–$13_7$ and reflector segment 10, so that feeds $14_1$–$14_6$ launch beams $16_1$–$16_6$, respectively, which, as shown in FIG. 4, provide respective footprints $21_1$–$21_6$ that are in an East-West alignment with footprints $20_1$–$20_7$ and also interleaved with footprints $20_1$–$20_7$ because of the offset feed arrangement in FIG. 3. Therefore, feeds $13_1$–$13_7$ and $14_1$–$14_6$ and reflector segments 10 and 11 in combination can provide full CONUS coverage without feed coupling losses.

Figure 5:
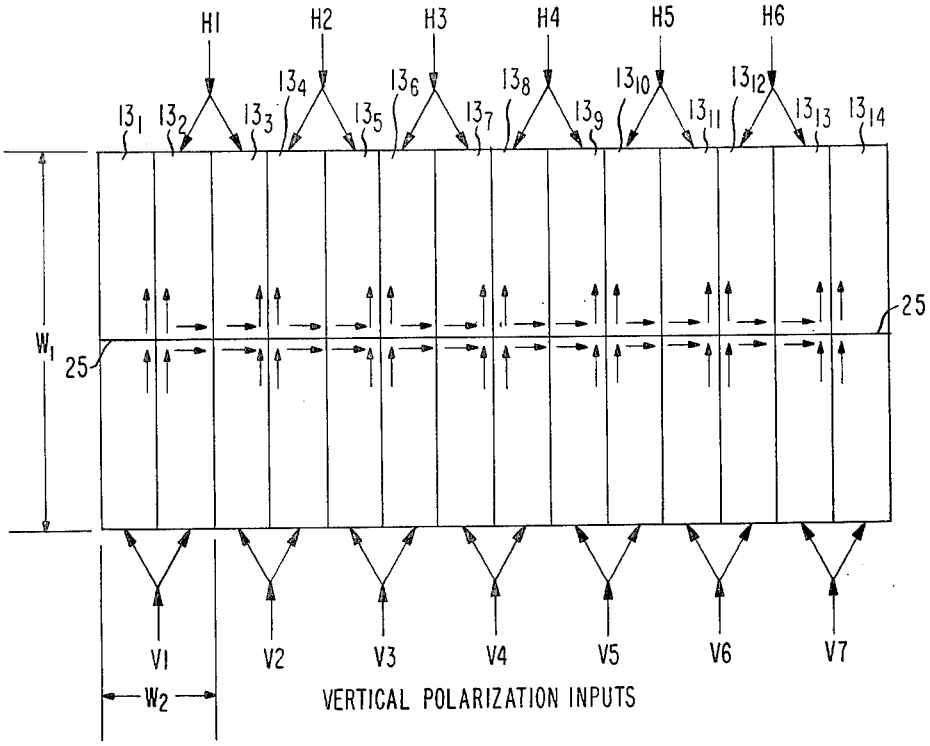
FIG. 5 is a front view of a linear array of equivalent quadruple horns which are staggered between polarizations.

To achieve a uniform coverage of CONUS with each reflector segment 10 and 11, a linear array of feeds 13 or 14 can be used in the form shown in FIG. 5. In FIG. 5, fourteen horn feeds $13_1$–$13_{14}$ are shown disposed in a line with the overall array having the same cross-sectional dimensions as the array of FIG. 3 and, in turn, can be used to replace the linear array $13_1$–$13_7$ of FIG. 3. In FIG. 5, each of the feeds $13_1$–$13_{14}$ include a major axis dimension of $W_1$ and a minor axis dimension of $W_2/2$, which minor axis dimension is half that of the feed 13 of FIG. 3. Additionally, each feed $13_1$–$13_{14}$ includes a vane 25 which divides the major axis dimension of each feed in half.

In the preferred operation, as shown in FIG. 5, a first vertically polarized signal is applied to the pair of feeds $13_1$ and $13_2$ by any well-known arrangement, a second vertically polarized signal is applied to the pair of feeds $13_3$ and $13_4$, and in like manner a third to seventh vertically polarized signal is applied to each of the sequential separate pair of feeds $13_5$, $13_6$ to $13_{13}$, $13_{14}$, respectively. In a similar manner, a first horizontally polarized signal is applied to the pair of feeds $13_2$ and $13_3$ by any well-known arrangement, a secod horizontally polarized signal is applied to the pair of feeds $13_4$ and $13_5$, and in like manner a third to sixth horizontally polarized signal is applied to each of the sequential separate pair of feeds $13_6$, $13_7$ to $13_{12}$, $13_{13}$, respectively. With such operation, each of the seven vertically polarized signals $V_1$–$V_7$ is launched by the antenna arrangement of FIGS. 1 and 5 in beams $15_1$–$15_7$, respectively, and would produce the respective footprints $20_1$–$20_7$ in FIG. 4, while each of the six horizontally polarized signals $H_1$–$H_6$ when launched in beams $16_1$–$16_6$, respectively, would produce the respective footprints $21_1$–$21_6$ in FIG. 4.

With the feed array $13_1$–$13_{14}$ of FIG. 5 replacing, for example, the feed array $13_1$–$13_7$ of FIG. 3 in the antenna arrangement of FIG. 1, full CONUS coverage can be achieved by the 13 beams reflected by reflector segment 10 as shown in FIG. 4. Another feed array of FIG. 5 can also be disposed in place of feeds $14_1$–$14_6$ of FIG. 3 but not offset from the array of feeds $13_1$–$13_{14}$ to also produce 13 beams which are reflected by reflector segment 11 to also provide the footprints of FIG. 4. In this manner, beams can be fully superimposed on corresponding beams from another array. If, however, the reflector segments 10 and 11 are slightly tilted with respect to each other, or the arrays are slightly offset in a North-South direction on the far field images, then the beams can be made to only partially overlap each other in a North-South direction of FIG. 4. Alternatively, if the corresponding feeds of the array are offset by a predetermined amount in the manner shown in FIG. 3, then the beams can be made to partially overlap by said predetermined amount in an East-West direction in FIG. 4. Then by placing phase shifters at the input to corresponding feeds of overlapping beams and applying a predetermined phase shift between the overlapping beams, the signals can be diected via a stepped wavefront to a predetermined area within the overlapping footprint portion. It is to be understood that in the arrangement of FIG. 5, the effective quadruple aperture horn feed produced by the feeding of a signal into two adjacent horns comprising a horizontal and vertical separation therein is used to produce equalized principal plane beamwidths.

Figure 6:
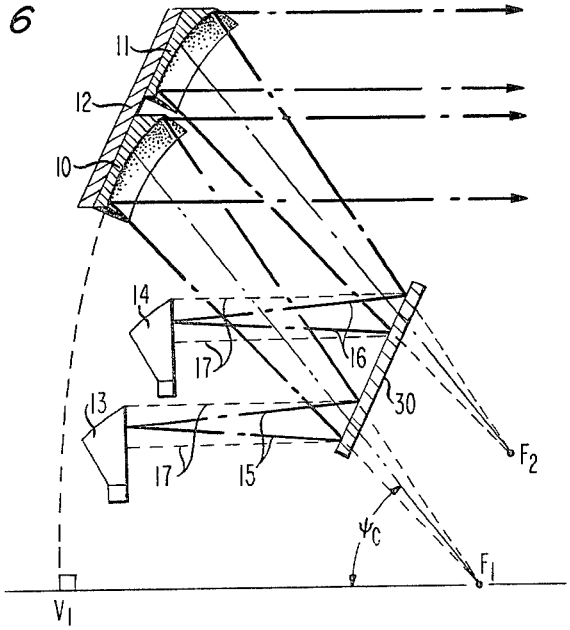
FIG. 6 is an antenna arrangement similar to the antenna arrangement of FIG. 1 but including a flat subreflector for directing the beams between the associated main reflector segments and feeds.

FIG. 6 illustrates an extension of the antenna arrangement of FIG. 1. In FIG. 6, the antenna arrangement includes curved focusing reflector segments 10 and 11 disposed on a mounting member 12, with each reflector segment reflecting surface being associated with a separate focal point $F_1$ and $F_2$ as in FIG. 1. In FIG. 6, however, a flat subreflector 30 is disposed between reflector segments 10 and 11 and their associated focal points $F_1$ and $F_2$ to reflect the beams 15 and 16 between feeds 13 and 14 and the reflector segments 10 and 11, respectively. It is to be understood that the heretofore principles described for FIGS. 2–5 can also be applied to the antenna arrangement of FIG. 6.

Figure 7:
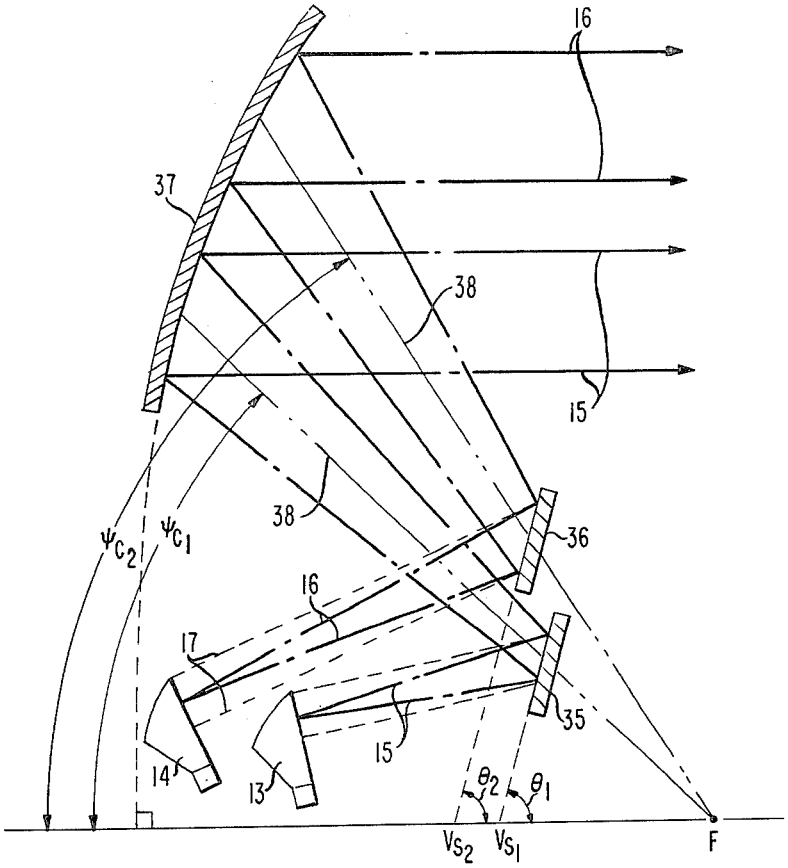
FIG. 7 is an alternative arrangement to the antenna arrangement of FIG. 6 wherein the antenna arrangement includes a segmented subrefletor and a single main reflector.

FIG. 7 is an alternative antenna arrangement to that of FIG. 6. In FIG. 7, the antenna arrangement comprises a first and a second flat subreflector segment 35 and 36 which are used to direct beams 15 and 16, respectively, between the respective feeds 13 and 14 and a curved focusing main reflector 37 having a focal point F. It is to be understood that the principles described hereinbefore for the arrangements of FIGS. 3–5 also can be applied to the antenna arrangement of FIG. 7. It is to be further understood that subreflector segments 35 and 36 can each comprise a curved reflecting surface which focuses the associated spherically shaped beam to a predetermined focal point along a central ray 38 of the beam between the associated subreflector segment and main reflector 37. With the curved subreflector reflecting surfaces, the associated beam 13 or 14 will again become a spherically shaped beam on either side of the predetermined focal point and, for example, would be converted by main reflector 37 into planar wavefront as described hereinbefore for the antenna arrangements of FIGS. 1 and 6.

It is to be understood that the above-described embodiments are simply illustrative of the principles of the invention. Various other modifications and changes may be made by those skilled in the art which will embody the principles of the invention and fall within the spirit and scope thereof. For example, it is to be understood that additional main reflector or subreflector segments and associated feed arrays could be used in the arrangements of FIGS. 1, 6 or 7 to provide additional fully or partially overlapping beams.

What is claimed is:

1. A multibeam antenna comprising:

a reflector comprising a first and a second segment of a reflecting surface, the first and second segments being disposed in a noninterfering configuration to one another to form a separate corresponding first and second image, respectively, of a far field area of the antenna over a separate respective first and second focal surface; and a plurality of feeds, each feed being both capable of radiating or receiving a separate beam of electromagnetic energy and disposed at a separate predetermined location on either one of the first and the second images of the far field area, where first and second feeds which are located in essentially corresponding locations on the first and second images, respectively, of the far field area provide separate beam footprints in the far field area which selectively overlap each other by a predetermined amount, which amount is dependent on the amount of overlap of the first and second feed apertures at the respective first and second images of the far field area.

2. A multibeam antenna according to claim 1 wherein the feeds associated with the first and the second reflector segments are disposed in a first and a second linear array, respectively, with the longitudinal cross-sectional axis of both the first and the second array being disposed essentially parallel to a major axis of the respective first and second reflector segments and the first and second arrays are disposed in a predetermined overlapping relationship on the first and second image, respectively.

3. A multibeam antenna according to claim 2 wherein separate first directionally polarized signals are applied to first sequential pairs of feeds of either one of the first and second linear arrays while second directionally polarized signals in an orthogonal direction to the first directionally polarized signals are applied to second sequential pairs of feeds of the linear array which second sequential pairs are offset from the first sequential pairs by one feed.

4. A multibeam antenna according to claim 1, 2 or 3 wherein the antenna further comprises a subreflector disposed to reflect beams of electromagnetic energy between each of the first and second segments and the feeds disposed on the first and second images, respectively, of the far field area.

5. A multibeam antenna according to claim 4 wherein the subreflector comprises a flat reflecting surface.

6. A multibeam antenna comprising:

a main reflector including a reflecting surface capable of bidirectionally reflecting beams of electromagnetic energy between an original focal surface and a far field area of the antenna;

a subreflector comprising a first and a second segment of a reflecting surface disposed between the main reflector and its original focal surface, the first and second segments being further disposed in a noninterfering configuration to one another to form a separate corresponding first and second image, respectively, of the far field area of the antenna over a separate respective first and second focal surface; and a plurality of feeds, each feed being both capable of radiating or receiving a beam of electromagnetic energy and disposed at a separate predetermined location on either one of the first and second images of the far field area, where first and second feeds which are located in essentially corresponding locations on the first and second images, respectively, of the far field area provide separate footprints in the far field area which selectively overlap each other by a predetermined amount, which amount is dependent on the amount of overlap of the first and second feed apertures at the respective first and second images of the far field area.

7. A multibeam antenna according to claim 6 wherein the feeds associated with the first and the second subreflector segments are disposed in a first and a second linear array, respectively, with the longitudinal cross-sectional axis of both the first and the second array being disposed essentially parallel to a major axis of the respective first and second subreflector segments and the first and second arrays are disposed in a predetermined overlapping relationship on the first and second images, respectively.

8. A multibeam antenna according to claim 7 wherein separate first directionally polarized signals are applied to first sequential pairs of feeds of either one of the first and second linear arrays while second directionally polarized signals in an orthogonal direction to the first directionally polarized signals are applied to second sequential pairs of feeds of the linear array which second sequential pairs are offset from the first sequential pairs by one feed.

* * * * *